United States Patent [19]

Zuckerman

[11] Patent Number: 4,826,460

[45] Date of Patent: May 2, 1989

[54] OUTBOARD MARINE ENGINE STABILIZING DEVICE

[76] Inventor: Steven Zuckerman, 2857 Winter Garden, Lexington, Ky. 40502

[21] Appl. No.: 177,394

[22] Filed: Apr. 4, 1988

[51] Int. Cl.[4] ..... B63H 5/12

[52] U.S. Cl. ..... 440/55; 440/63; 440/113; 440/900; 114/144 R

[58] Field of Search ..... 440/52, 53, 55, 63, 440/900; 114/144 R, 144 A; 74/480 B

[56] References Cited

U.S. PATENT DOCUMENTS 2,549,486 4/1951 Kiekhaefer ..... 440/63

2,714,362 8/1955 Schroeder ..... 74/480 B 3,599,594 8/1971 Taipale ..... 440/53

3,613,631 10/1971 Wick ..... 440/53

*Primary Examiner*—Sherman D. Basinger

*Assistant Examiner*—Jesûs D. Sotelo

*Attorney, Agent, or Firm*—Jon C. Winger

[57] ABSTRACT

A stabilizing device for an outboard marine motor includes a plate having two spaced apart arms which are adapted to be connected to opposite sides of the powerhead of the motor and adapted to be connected to the steering arm of the motor at the end of the plate generally opposite to the location of the connection of the arms to the motor.

10 Claims, 3 Drawing Sheets

OUTBOARD MARINE ENGINE STABILIZING DEVICE

BACKGROUND OF THE INVENTION

The present invention relates to accessories for use with marine outboard motors, and more particularly to a stabilizing device adapted to be mounted on a marine outboard motor to stabilize the engine against rocking, as well as decreasing torque steer and chine walk.

Marine outboard motors typically comprise a powerhead, a drive shaft housing attached to and suspended from the powerhead, a lower unit at the bottom end of the drive shaft housing, and a prop mounted at the lower unit. The outboard motor is mounted to the transom of a boat by a transom mounting bracket. The outboard motor is interconnected to the transom mounting bracket by an intervening tilt bracket which is connected to the transom mounting bracket and to the outboard motor. The tilt bracket is connected to the transom mounting bracket by a horizontal tilt pin which allows the outboard motor to be pivoted in a vertical plane into and out of the water. The tilt bracket is connected to the outboard motor by a vertical swivel pin which allows the outboard motor to be pivoted in a horizontal plane to steer the boat. The outboard motor is attached to the swivel pin by upper and lower motor swivel mounting brackets which are each attached at one end to the swivel pin and attached at the other end to the drive shaft housing. A steering arm is attached to the upper motor swivel mounting bracket and extends therefrom in a cantilever fashion over the top side boat transom. To steer the boat, the steering arm is moved in a horizontal plane to port or starboard thus causing the outboard motor to pivot about the vertical swivel pin in a horizontal plane changing the direction of the thrust vector generated by the prop. In order to dampen vibrations transmitted to the boat from the outboard motor to reduce vibration, noise, and structural fatigue to the boat, the outboard motor manufacturers use resilient motor mounts, usually rubber, at the connection of the upper and lower motor mounting bracket to the drive shaft housing.

Marine outboard motors are becoming more powerful each year. For example, factory stock motors of over 300 horsepower are now available. With these more powerful outboard motors the torque produced by the powerhead generates a substantial moment about the motor crankshaft and also about the center of the propeller which compresses the resilient motor mounts causing the outboard motor to "fish-tail". "Fishtailing" reduces the ability of the propeller to maintain a solid, continuous bite of the water. In addition, on V-bottom hull boats, the "fishtailing" of the engine will result in hull chine walk and on tunnel hulls it will result in the sponson-to-sponson bouncing. The compression of the resilient motor mounts also results in torque steering of the engine. These conditions decrease a driver's control over the boat.

An additional problem resulting from the compression of the resilient motor mounts is that the outboard motor, and more particularly the drive shaft housing, lower unit and propeller will crab or assume an angle to the direction of travel of the boat, i.e., in plan view the centerline of the propeller, and therefore the thrust vector generated by the propeller, will be at a slight angle to the longitudinal centerline or keel of the boat. A drive shaft housing and lower unit passing through water, at even a slight angle to the direction of travel, increases the possibility of propeller "blowout" or cavitation which causes the propeller to lose its bite. The result of propeller "blowout" can be a loss of control of the boat by the driver, damage to the propeller due to cavitation, and engine damage due to over-reving of the engine. In addition, the drive shaft housing and lower unit being at an angle to the direction of travel of the boat through the water is less hydrodynamic or streamlined than it is when in alignment with the direction of travel and, therefore, increases the hydrodynamic load or drag of the drive shaft housing and lower unit through the water.

U.S. Pat. No. 2,549,486 issued on Apr. 17, 1951 to E. C. Kiekhaefer shows a steering mounting for outboard motors. The function of the steering mounting device is to secure the outboard motor against a normal tendency of the motor to be turned on its steering axis by the vibration of the motor. The steering mounting device includes a circular bearing washer plate which has a central hole receiving the vertical pivot pin about which the outboard motor is pivoted to turn the boat to allow rotation of the washer plate relative to the vertical pivot pin. The washer plate also has flanges extending to each side of the vertical pivot pin. A compression spring is seated between each of these flanges and the outboard motor lower unit housing to secure the washer plate and outboard motor lower unit housing rotationally with respect to the axis of the pivot pin and to cushion the lower unit housing from vibration of the power unit. The entire weight of the power unit, and lower unit housing of the outboard motor are carried on the washer plate. The outboard motor is attached to the transom of a boat by a swivel bracket which is connected to the lower unit housing. A friction washer is located between the swivel bracket and bottom surface of the washer plate. A tiller handle is secured to the washer plate and extends over the swivel bracket into the boat. By securing the tiller handle to the washer plate, the handle is relieved or isolated from the vibration generated by the power unit. The device also includes adjustable pressure discs between the swivel bracket and washer plate bearing down against the upper surface of the washer plate. These adjustable pressure discs provide for the adjusting the frictional forces between the swivel bracket and washer plate to increase or decrease the steering effort of the motor about its steering axis to prevent the motor from turning by the vibration of the motor.

U.S. Pat. No. 2,714,362 issued on Aug. 2, 1955 to S. E. Schroeder teaches a steering adapter assembly for an outboard motor to adapt the outboard motor for steering from the forward portion of the boat to which the outboard motor is attached. The steering adapter assembly includes a bracket having two parallel rigid legs extending in one direction, and two parallel resilient arms extending in the opposite direction. The bracket is affixed to the outboard motor by bolts which attach the rigid legs to the outboard motor on opposite sides thereof so that the resilient arms extend to the rear of the outboard motor. A tiller rope is connected to the free ends of the resilient arms, and extend therefrom back over the boat transom to a steering wheel at the front of the boat. The resilient arms retain the tiller rope taut for effectively transmitting movement of the tiller rope to the motor for accurate steering control of the boat.

U.S. Pat. Nos. 2,549,496 and 2,714,362 are directed to devices for turning the outboard motor about a vertical pivot axis for pivoting the motor about this pivot axis to steer the boat to which the motor is attached. These steering devices do not address nor solve the above-discussed problems.

U.S. Pat. No. 3,613,631 issued on Oct. 19, 1971, to Gerald H. Wick shows a special transom mounting bracket secured to the engine about the power unit by an upper resilient mount and to the drive unit by a lower resilient mount to reduce the steering torque and vibration transmitted to the hand-held steering tiller of small engines. This proposed special mounting bracket does not solve the problems described above because it still relies on flexible mounts and is not suitable for high horsepower engines with remote steering systems. Furthermore, this special transom mounting bracket would be expensive because it would require a particularly designed motor and would not be practical as an after market replacement because it would involve extensive engine modifications.

A proposed solution to the above-discussed problems is to replace the resilient motor mounts with rigid mounts. This proposal may eliminate chine walk and torque steer due to compression of the flexible motor mounts, however, it is a difficult, time-consuming task to replace the mounts and, therefore, expensive. Furthermore, the substitution of rigid motor mounts for the flexible mounts will allow the engine vibration and engine forces to be transferred to the transom of the boat subjecting the transom to damage.

SUMMARY OF THE INVENTION

The present invention recognizes the above-mentioned problems causing chine walk and torque steer and the adverse effects thereof, and provides a straightforward solution.

The present invention returns control of the boat to the driver by by-passing the resilient motor mounts directly linking the steering arm of the motor to the powerhead and consequently to the drive shaft housing, and the lower unit.

The present invention provides for eliminating "fishtailing" of the lower unit of the outboard motor without losing the damping benefits provided by the resilient motor mounts.

The present invention provides a solution to chine walk and torque steer which does not require the replacement of the resilient motor mounts.

The present invention further provides a solution to chine walk and torque steer which can be implemented in a minimum time and labor.

The present invention still further provides a solution to chine walk and torque steer which is well suited for after-market installations.

The present invention even further provides a solution to chine walk and torque steer which does not require modification of the outboard motor.

More particularly, the present invention provides a stabilizing device for use with an outboard marine motor of the type having a powerhead, a drive shaft housing attached to and suspended from the powerhead, and a steering arm projecting in a cantilevered manner from the drive shaft housing, comprising a stiff plate member having two arms, one plate member arm being adapted to be rigidly connected to the powerhead at one lateral side thereof and the other plate member arm being adapted to be rigidly connected to the powerhead at the other lateral side thereof, and said plate being adapted to be rigidly connected to the steering arm of the outboard motor.

BRIEF DESCRIPTION OF THE DRAWINGS

These and other features of the present invention will become even more clear upon reference to the following description and in conjunction with the accompanying drawings wherein like numerals refer to like parts throughout the views and in which.

DESCRIPTION OF THE PREFERRED EMBODIMENT

Figure 1:
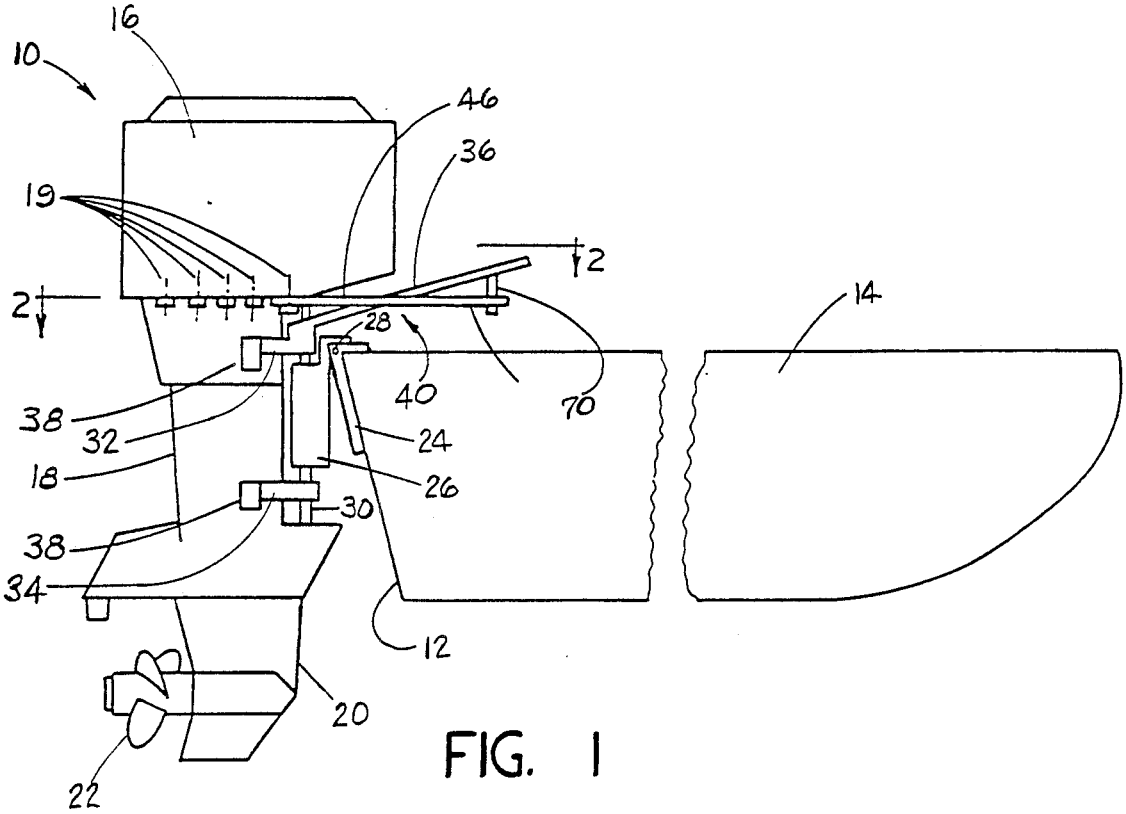
FIG. 1 is a side view of a representative marine outboard engine having the stabilizing device of the present invention attached thereto.
Figure 2:
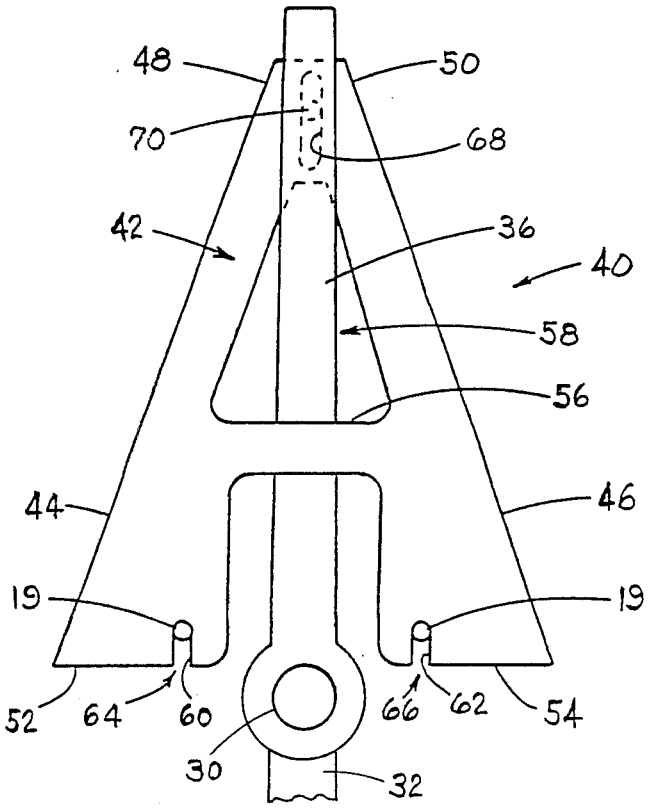
FIG. 2 is a view taken in the direction of arrows 2—2 in FIG. 1.
Figure 3:
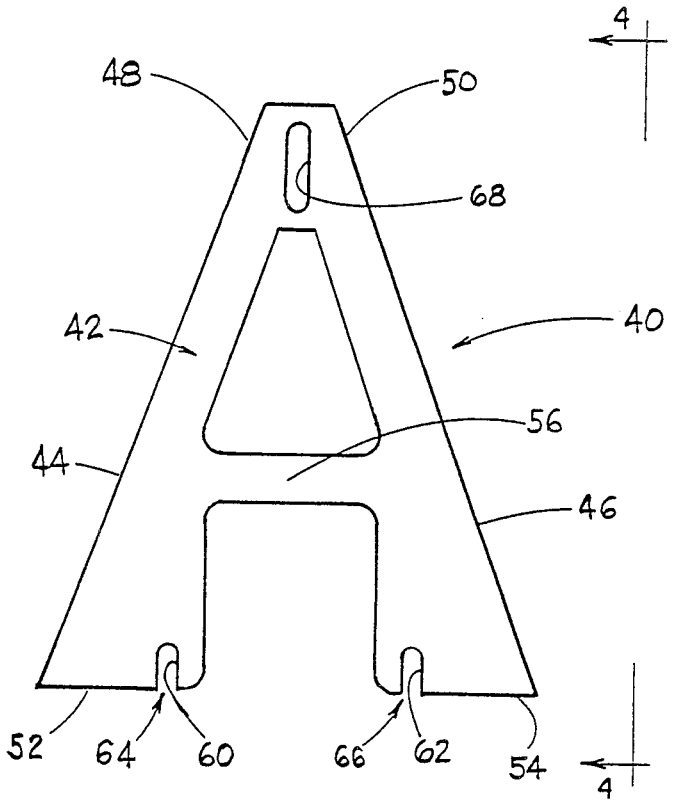
FIG. 3 is a top view of the stabilizing device of the present invention.
Figure 4:
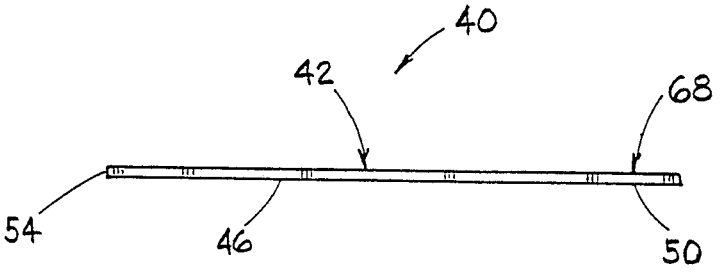
FIG. 4 is a side view of the stabilizing device as seen in the direction of arrows 4—4 in FIG. 3; and, FIG. 5 is a top view of a somewhat different embodiment of the stabilizing device of the present invention.

With reference to FIG. 1, there is shown a typical marine outboard motor, generally denoted by the numeral 10, mounted on the transom 12 of a boat 14. The typical outboard motor 10 includes a powerhead 16 with a drive shaft housing 18 attached to and suspended from the powerhead 16. The drive shaft housing 18 is attached to the powerhead 16 by means of a plurality of bolts 19 at the junction of the powerhead 16 and drive shaft housing 18.

With continued reference to FIG. 1, the outboard motor 10 further includes a lower unit 20 at the bottom end of the drive shaft housing 18 with a propeller 22 mounted at the lower unit 20. The outboard motor 10 is mounted to the boat transom 12 by a transom mounting bracket 24. The outboard motor 10 is interconnected to the transom mounting bracket 24 by an intervening tilt bracket 26. The tilt bracket 26 is connected to the transom mounting bracket 24 by a horizontal tilt pin 28 which allows the outboard motor 10 to be pivoted in a vertical plane into and out of the water. The tilt bracket 26 is connected to the outboard motor 10 by a vertical swivel pin 30 which allows the outboard motor to be pivoted in a horizontal plane to steer the boat. The outboard motor 10 is attached to the swivel pin 30 by an upper motor swivel bracket 32 and a lower motor swivel bracket 34. Each of the swivel brackets 32 and 34 is attached at one end to the swivel pin 30 and is attached at the other end to the drive shaft housing 18. A steering arm 36 is attached to the upper motor swivel mounting bracket 32 and extends therefrom in a cantilever fashion over the top side of the boat transom 12. In order to reduce and dampen the transmission of torque forces, vibrations, and noise generated by the motor to the boat transom 12 resilient motor mounts 38, usually made of rubber, are located at the interface of the connection of the upper swivel mounting bracket 32 to the drive shaft housing 18 and the connection of the lower swivel mounting bracket 34 to the drive shaft housing 18.

With reference to FIGS. 1–4, the stabilizing device of the present invention, generally denoted by the number 40, is illustrated as being a substantially rigid, generally planar plate member 42 comprising two spaced apart rearwardly projecting arms 44 and 46 which are adapted to be connected to the powerhead 16 on opposite lateral sides thereof. Toward this end, the arms 44 and 46 are spaced apart by a distance corresponding to the width of the powerhead 16. The plate member 42 is illustrated as being generally "A" shaped in plan view wherein the arms 44 and 46 are disposed at an acute included angle to each other and merge at one of their ends 48 and 50 to form the apex of the "A" shape with the other ends 52 and 54 being free. A crossbar 56 spans the distance between the arms 44 and 46 to reinforce the arms 44 and 46, and cooperates with the arms 44 and 46 to define a clearance opening 58 between the crossbar 56 and apex of the "A" shape for the marine engine steering arm 36. As shown, the arms 44 and 46 and crossbar 56 are integrally formed. However, it is contemplated that the arms 44 and 46 and crossbar 56 could be separate components and joined together by, for example, welding. Preferably, the plate 42 is fabricated of a strong, corrosion resistant material, substantially rigid material such as for example, stainless steel or aluminum.

The free ends 52 and 54 of the arms 44 and 46, respectively, are adapted to be connected to the powerhead 16 by means of apertures 60 and 62 formed in the free ends 52 and 54, respectively. The apertures 60 and 62 are shown as being slots each open to the free end of the arm in which it is formed as indicated by the numbers 64 and 66. Preferably, the longitudinal axes of the slotted apertures 60 and 62 are generally mutually parallel and parallel to the longitudinal centerline of the "A" shape of the plate 40. The slotted apertures 60 and 62 are each adapted to receive therein a different one of the bolts 19 on opposite sides of the powerhead 16 which secures the drive shaft housing 18 to the powerhead 16.

The stabilizing plate 42 is interconnected to the free end of the outboard motor steering arm 36 by means of a hole 68 located near the apex of the "A" shaped plate 42. The hole 68 is sized to receive a steering link pivot pin or bolt 70 which projects from the steering arm 36. The hole 68 is shown as being elongated with its length large enough to allow the steering arm link pin or bolt 70 to move freely longitudinally of the hole 68 while still preventing movement of the pin or bolt 70 laterally of the elongated hole 68.

To install the stabilizing device 40, a selected one of the bolts 19 on each side of the powerhead 16 is loosened just enough to receive the thickness of the plate 42 between the bolt head and adjacent surface of the powerhead 16. The plate 42 is positioned with the outboard motor steering arm 36 projecting through the clearance opening 58 of the plate 42 and the apex of the "A" shape generally pointing away from the powerhead 16. The plate 42 is then moved to a generally horizontal position overlapping the steering arm 36 with the steering link pivot pin or bolt 70 received in the elongated hole 68 of the plate 42 and the arms 44 and 46 located to opposite lateral sides of the powerhead 16. The slotted apertures 60 and 62 in the plate arms 44 and 46 are aligned with the loosened bolts 19 on its side of the powerhead 16 and plate 42 is moved rearwardly so that the exposed shank of one, loosened bolt 19 is received through the open end 64 of the slotted aperture 60 of plate arm 44 and the exposed shank of the other loosened bolt 19 on the other side of the powerhead 16 is received through the open end 66 of the slotted aperture 62 of the plate arm 46. The loosened bolts 19 are next re-tightened to secure the plate arms 44 and 46 to the powerhead 16 proximate the juncture of the powerhead 16 and drive shaft housing 18.

Figure 5:
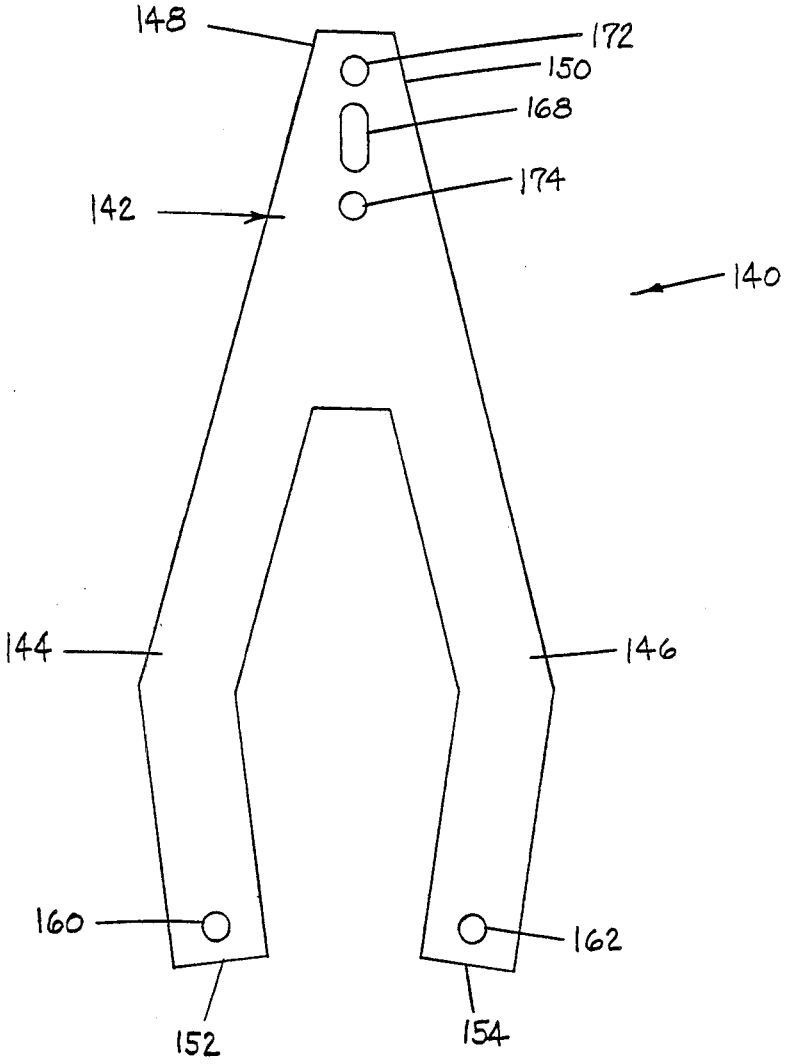

With reference to FIG. 5, there is shown a somewhat differently configured stabilizing device of the present invention, generally denoted as the numeral 140, which is also shown as being a generally planar plate member 142 comprising two spaced apart rearwardly projecting arms 144 and 146 which are adapted to be connected to the powerhead 16 on opposite lateral sides thereof. The arms 142 and 144 are integrally joined together at one of their ends 148 and 150. The arms 144 and 146 diverge from their joined ends for a distance approximately two-thirds of their length and then converge terminating in free ends 152 and 154, respectively. The free ends 152 and 154 are transversely spaced apart by a distance corresponding to the width of the powerhead 16. Apertures 160 and 162 are formed in the free ends 152 and 154, respectively. The stabilizing plate 142 also includes an elongated hole 168 at the joined ends 148, 150 of the arms 144 and 146, a first hole 172 in alignment with the elongated axis of the elongated hole 168 spaced to one end of the elongated hole 168, and a second hole 174 in alignment with the elongated axis of the elongated hole 168 spaced to the opposite end of the elongated hole 168. The elongated hole 168, or first hole 172, or second hole 174 receives the steering link pivot pin or bolt 70 of the outboard motor steering arm 36 depending upon the length of the steering arm 36 which may vary between different outboard motor brands or models of a single outboard motor brand.

To install the stabilizing device 140, a selected one of the bolts 19 on each side of the powerhead 16 are removed. The plate 142 is positioned with the arms 144 and 146 extending to opposite lateral sides of the powerhead 16 and the outboard motor steering arm 36 projecting through the space between the arms 144 and 146 with the apex of the plate 142 pointing away from the powerhead 16 and overlapping the steering arm 36. The steering link pivot pin or bolt 70 is then received in whichever one of the elongated hole 168, or first hole 172, or second hole 174 which is in alignment with the steering link pivot pin or bolt 70. The removed bolts 19 are inserted through the apertures 160 and 162 in the plate arms 144 and 146 and reinstalled to the powerhead 16.

Thus, it can be appreciated that the stabilizing device 40, 140 of the present invention can be installed on a marine outboard motor without having to disassemble the motor and without disturbing the function of the resilient engine mounts 38 while still rigidly attaching the powerhead 16, drive shaft housing 18, and lower unit 20 to the outboard motor steering arm 36.

That is, the resilient motor mounts 38 still function to dampen the torque forces, vibration, and noise generated by the motor and reduce their transmission to the boat transom while at the same time, and without interfering with the function of the mounts 38, the stabilizing device 40, 140 eliminates the motion of the powerhead 16, drive shaft housing 18, and lower unit 20 relative to the steering arm 36 due to the compression and expansion of the resilient motor mounts 38. The elimination of this relative motion due to the resilient motor mounts prevents the above discussed outboard motor "fishtailing" along with the attendant results of boat chine walk, sponson-to-sponson bouncing, torque steer, outboard motor crabbing, propeller "blow out", and increased hydrodynamic drag.

The foregoing detailed description is given primarily for clearness of understanding and no unnecessary limitations should be understood therefrom for modifications will become obvious to one skilled in the art upon reading this disclosure and can be made without departing from the spirit of the invention and scope of the appended claims.

What is claimed is:

1. A stabilizing device for use with an outboard marine motor of the type having a powerhead, a drive shaft housing attached to and suspended from the powerhead, motor mounting brackets interconnecting the drive shaft housing to a motor swivel pin with resilient mounts at the interface of the motor mounting brackets and drive shaft housing, and a motor steering arm attached to the motor mounting brackets to pivot the motor about the motor swivel pin, comprising means for substantially rigidly attaching the powerhead to the motor steering arm.

2. The stabilizing device of claim 1, wherein the means for rigidly attaching the powerhead to the motor steering arm comprises a rigid plate member adapted for rigid connection to the powerhead at one end of the plate and for rigid connection to the motor steering arm at the other end of the plate.

3. The stabilizing device of claim 2, wherein the rigid plate is adapted for connection to the powerhead proximate the junction of the powerhead and drive shaft housing.

4. The stabilizing device of claim 3, wherein the rigid plate is adapted for connection to the motor steering arm proximate the free end of the motor steering arm.

5. The stabilizing device of claim 4, wherein the rigid plate comprises:

two substantially rigid arms, one arm being adapted for rigid connection to the powerhead proximate the junction of the powerhead and drive shaft housing to one lateral side of the powerhead, and the other arm being adapted for rigid connection to the powerhead proximate the junction of the powerhead and drive shaft housing to the opposite lateral side of the powerhead; and, each rigid arm also being adapted for rigid connection to the motor steering arm.

6. The stabilizing device of claim 5, wherein the rigid arms define a clearance opening therebetween to receive the motor steering arm therethrough.

7. The stabilizing device of claim 5, wherein the two rigid arms are each formed with an aperture for receiving a fastener connecting the powerhead to the drive shaft housing.

8. The stabilizing device of claim 5, wherein the rigid plate is formed with an aperture for receiving a fastener connecting the motor steering arm to the plate.

9. The stabilizing device of claim 5, wherein the two rigid arms are merged at one of their ends and extend at an acute included angle to each other terminating at laterally spaced apart free ends.

10. A marine outboard motor comprising:

a powerhead;

a drive shaft housing attached to and suspended from the powerhead;

a transom mounting bracket;

a motor tilt bracket attached to the transom mounting bracket;

a motor swivel pin connected with the motor tilt bracket;

a motor mounting bracket connected to the motor swivel pin and connected to the drive shaft housing;

resilient motor mounts at the interface of the connection of the motor mounting bracket to the drive shaft housing;

a motor steering arm connected to the motor mounting bracket and extending in a cantilever manner therefrom; and, means for substantially rigidly attaching the powerhead to the motor steering arm.

* * * * *